US006273330B1

(12) United States Patent
Oliff et al.

(10) Patent No.: US 6,273,330 B1
(45) Date of Patent: Aug. 14, 2001

(54) CARTON WITH TRANSVERSE STRAP HANDLE

(75) Inventors: James R. Oliff, Douglasville; Aaron Bates, Marietta; Ronald A. Baxter, Douglasville; John M. Holley, Jr., Lawrenceville, all of GA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/544,122

(22) Filed: Apr. 6, 2000

(51) Int. Cl.[7] ..... B65D 5/468
(52) U.S. Cl. ..... 229/117.13; 229/117.12
(58) Field of Search ..... 229/117.12, 117.13; 206/141, 427

(56) References Cited

U.S. PATENT DOCUMENTS

| | | | | |
|---|---|---|---|---|
| 2,482,399 | | 9/1949 | Bullock | 229/117.13 |
| 2,723,027 | * | 11/1955 | Guyer | 229/117.13 |
| 2,811,250 | * | 10/1957 | Arneson | 229/117.13 |
| 2,896,838 | | 7/1959 | Struble | 229/117.12 |
| 3,094,268 | | 6/1963 | Swanson et al. | 229/117.13 |
| 3,300,119 | | 1/1967 | Chaussadas | 206/434 |
| 3,933,303 | | 1/1976 | Kirby, Jr. | 229/117.13 |
| 4,582,199 | * | 4/1986 | Schuster | 206/427 |
| 4,747,534 | * | 5/1988 | Marie | 229/117.12 |
| 5,222,658 | * | 6/1993 | DeMaio et al. | 229/117.13 |
| 5,328,081 | * | 7/1994 | Saulas | 229/117.12 |
| 5,333,734 | | 8/1994 | Stout et al. | 206/427 |
| 5,385,234 | | 1/1995 | Stout et al. | 206/427 |
| 5,480,091 | | 1/1996 | Stout | 229/117.14 |
| 5,593,027 | | 1/1997 | Sutherland | 206/170 |
| 5,595,292 | * | 1/1997 | Bates | 206/141 |
| 5,794,778 | * | 8/1998 | Harris | 229/117.13 |
| 5,826,782 | | 10/1998 | Stout | 229/117.13 |
| 5,873,515 | | 2/1999 | Dunn et al. | 229/117.13 |

FOREIGN PATENT DOCUMENTS 2 252 958 A 8/1992 (GB) .

* cited by examiner

*Primary Examiner*—Gary E. Elkins
(74) *Attorney, Agent, or Firm*—John L. James; Michael V. Drew

(57) ABSTRACT

A beverage carton has a center panel, a left panel foldably connected to the center panel along a left fold line, a right panel foldably connected to the center panel along a right fold line, and a strap handle formed from the center, left and right panels. The strap handle extends transversely, instead of longitudinally, across the center panel between the left and right panels to absorb lifting forces in the side panels rather than end panels of the carton.

30 Claims, 8 Drawing Sheets

CARTON WITH TRANSVERSE STRAP HANDLE

FIELD OF THE INVENTION

The present invention relates generally to a product carton, and, more particularly, to a carton with a strap handle.

BACKGROUND OF THE INVENTION

Product cartons, such as those used for bottles and cans of beverages and food supplements, are often equipped with hand holds or strap handles which make the cartons easier to carry.

Lifting a carton and its contents by a strap handle causes the weight of the package to be concentrated at the handle, certain areas of the panel (generally because of orientation considered to be the top panel) to which the handle is attached and other portions of the carton. The concentration of weight produces stress that can cause deformation and failure of the handle and various carton panels (particularly the top panel). Although the problems of deformation, failure and otherwise tearing can sometimes be addressed by using multiple plies of carton material and/or by using material of a higher caliper or thickness, such measures increase the cost of cartons. It can be appreciated that it would be desirable to have a strap handle that does not tear easily, that does not require carton panels to be reinforced or made of thicker material and that does not otherwise diminish the structural integrity of the carton while also conserving the quantity of carton material used.

SUMMARY OF THE INVENTION

The present invention is directed to overcoming one or more of the problems set forth above. Briefly summarized, according to one aspect of the present invention, a carton has top and bottom panels and first and second opposed side panels. A strap handle is formed in the top and side panels and extends transversely across the top panel between the side panels. The handle is integrally formed with the side panels and connects to the top panel using web panels. Web panels fold up spacing the handle from the top panel for easy gripping. Load is distributed from the handle directly to the side panels, and is encouraged to spread throughout the side panels by the dimensions and positioning of the handle and a score line disposed at the connection of the handle and side panels.

According to another aspect of the invention, a strap handle is formed in the side and top and bottom panels, and extends transversely across the side panel between the top and bottom panels. The carton is carried with the side panel facing upwardly. The load is transferred from the handle to the top and bottom panels to which the handle connects.

The strap handle is also useful for cartons for longneck bottles. The handle is formed in side and top panels. The carton is carried with the bottles oriented horizontally instead of vertically.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

It is to be noted that throughout the description and claims that follow, designation of panels as "top" or "side" is for convenience of reference with respect to the drawings in explaining the invention. Use of these terms does not and are not intended to place additional limitations upon those panels.

Figure 1:
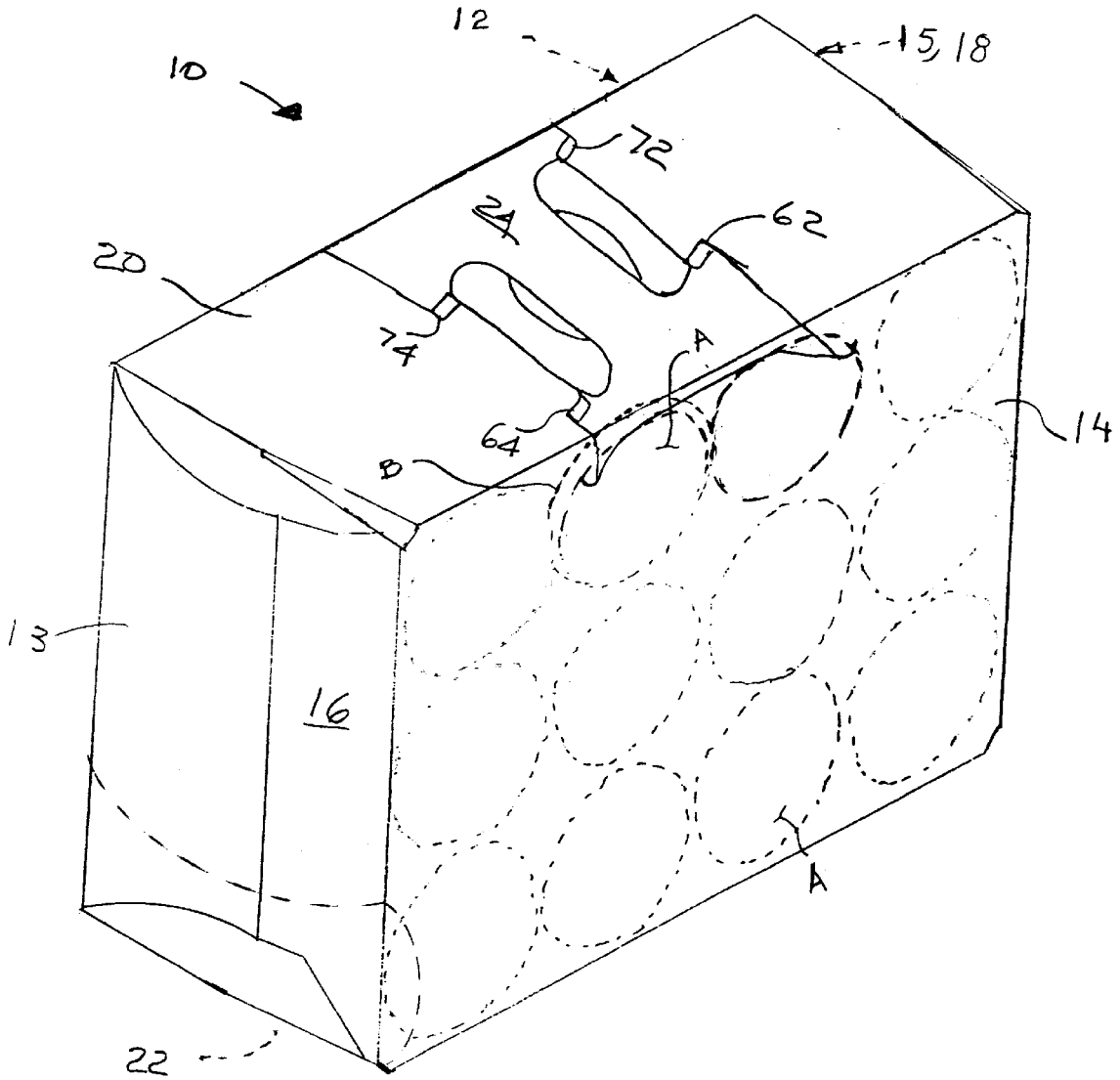
FIG. 1 is a perspective view of a preferred embodiment of a set-up product carton with a transverse strap handle formed from a single blank according to the present invention.
Figure 2:
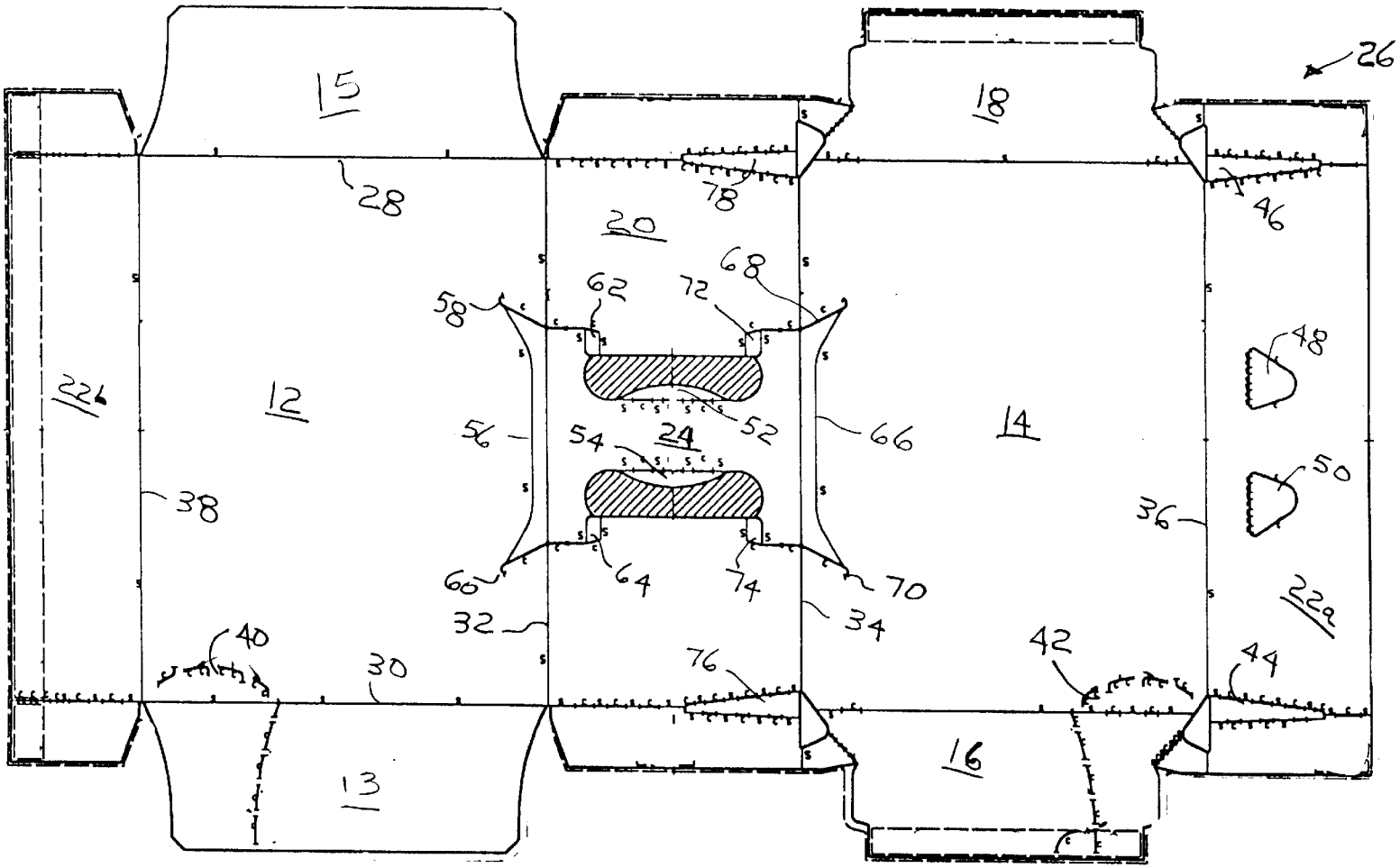
FIG. 2 illustrates the blank for the transverse strap handle of FIG. 1.

Referring to FIGS. 1 and 2, a carton 10 formed of side panels 12, 14, end panels 13, 15, 16, 18, and top and bottom panels 20, 22. Carton 10 is equipped with a strap handle 24 that is oriented transversely as opposed to longitudinally. Transverse handle 24 is oriented so that a hand grasps it with the fingers extended between end panels 13/16 and 15/18 instead of extending between side panels 12 and 14. As illustrated, carton 10 holds twelve beverage containers A forming a 12-pack in this instance. In this embodiment, the cans or other articles packaged within the carton are disposed with their longitudinal axis parallel to the transverse orientation of the handle. When lifted by transverse strap handle 24, the lifting force provided by handle 24 is directed to side panels 12 and 14 instead of top panel 20 or end panels 13/16 and 15/18 or corners of the carton as is the case with traditional longitudinal strap handles. The lifting force is thus spread over a wide area and there is no need to increase the thickness of the material of the carton to accommodate the load or prevent tearing. A number of strategic cuts and folds allows handle 24 to be raised up sufficiently to insert a hand to grip it and thus carry the carton.

FIG. 2 illustrates a blank 26 from which carton 10 can be formed. Blank 26 is preferably formed from a single piece of material divided by fold lines 28 and 30 into end panels and central panels. Top panel 20 is divided into the central top panel 20 and end portions. Similarly, side panels 12 and 14 are divided into the central panel portions and into end panel portions 13, 15 and 16, 18. Top panel 20 is connected to side panel 12 along fold line 32 while it is connected along fold line 34 to side panel 14. Side panel 14 is connected along fold line 36 to bottom panel 22*a,* while bottom panel 22*b* is connected along fold line 38 to side panel 12.

Blank 26 can be scored along the side panels and attached end panels with interrupted cut lines 40, 42 allowing material to be removed from those panels forming a dispenser for the cans. Bottom panel 22 contains score lines forming small triangular panels 44, 46 which flex tending to alter the shape of what would otherwise be perfectly square corners somewhat. This flexing accommodates the truncated corners of panel 14. Bottom panel 22 may also contain score lines defining removable panels 48 and 50.

Panel 14 has truncated corners giving it an octagonal configuration. A cutout exists in the blank at each corner of panel 14, but the end portions of panel 14 are connected to the adjoining end portions of panels 20 and 22 by connecting webs that are connected along fold lines to panels 20 and 22 and by score lines to the end panels 16, 18 of panel 14. This allows the end panels to be neatly folded during construction of the carton. The octagonal panel may be more aesthetically appealing than the square cornered panel and thus may be used as a display panel. Octagonal corners also tend to compensate somewhat for shelf spaces that are not always exactly square.

Transverse handle strap 24 has the main strap portion defined between two cutouts in top panel 20. Handle flaps 52, 54 are connected along score lines to handle 24 to increase the thickness of the strap making for a more comfortable handhole in the assembled carton. The entire handle assembly stretches across top panel 20 over onto side panels 12 and 14. The handle assembly thus extends across fold lines 32 and 34. The handle assembly terminates at panel 12 along a fold line 56. Fold line 56 has a central portion with end portions angled toward panel 12. This gives fold line 56 a concave or inverted "C" configuration with the ends of the "C" terminating at or near top and bottom cut lines 58 and 60. Cut line 58 extends diagonally downward toward fold line 32 then progresses horizontally onto panel 20. Similarly, cut line 60 extends diagonally upward across panel 12 to fold line 32 and then horizontally across panel 20. To prevent tearing and to further direct lifting forces into the bulk of panels 20 and 22, the end portions of cut lines 58 and 60 are preferably J-shaped with the backs of the J's toward one another so that the end of the J's curve away from one another in panel 12. A shape other than a J-shape can be used as long as it curves away from the stress areas to prevent tearing and allow forces to spread to the bulk of the panel. Preferably, cut lines 58 and 60 are not complete cut lines but are serrated to be easily separated after the carton is erected.

A web panel 62 exists between the top handhole cutout in panel 20 and the horizontal portion of cut line 58 in panel 20. Panel 62 is defined by vertical fold lines and horizontal cut lines. When folded along the fold lines, main handle portion 24 can be lifted up out of the plane of panel 20. This makes room for a hand to be inserted to lift the carton. Similarly, along the bottom portion of handle 24 a second web panel 64 is foldably connected to operate in concert with web panel 62. Panel 64 extends along the horizontal portion of cut line 60 in panel 20.

Panels 14 and 20 work in concert about the handle to form a mirror image of the stress-directing vertical fold line and cut lines. Vertical fold line 66 is thus the mirror image of vertical fold line 56 and serves to direct lifting forces into the bulk of panel 14 to prevent tearing of the panel when the carton is lifted. Vertical fold line 66 terminates at its top end at or near top cut line 68 and terminates its bottom end at or near bottom cut line 70. The fold lines 56, 66 optimally can be spaced a distance from associated corner edges 32, 34 so that when the carton is loaded with articles A such as cans having a shoulder B, the portion of the carton overlying the shoulder when the carton is lifted can be encouraged to conform to the slope of the shoulder. Because of this feature, cans or other articles having shoulders do not hamper the manner in which stress is directed by fold lines 56, 66. Cut line 68 is a mirror image of cut line 58, while cut line 70 is the mirror image of cut line 60. A top web panel 72 that is associated with cut line 68 is the mirror image of web panel 62, while web panel 74 that is associated with cut line 70 is the mirror image of web panel 64. When blank 26 is erected into a carton, lifting forces generated by handle 24 are spread out along panels 12 and 14 and across bottom panel 22.

Top panel 20 also contains triangular panels 76 and 78 similar to triangular panels 44 and 46 and perform similar functions. In addition, these panels compensate somewhat for distorted cans or damage to the carton during shipment. They allow for a slight expansion or bulging of the carton without compromising the structural integrity. Also, by affixing the handle in the transverse direction, the lifting forces are directed into the bulk of the material and not directly at any cut, fold, corner or weak point of the carton. The lifting forces are directed such that they are spread out to be carried by the bulk of the material rather than relying upon a special construction feature to provide the necessary strength.

Figure 3:
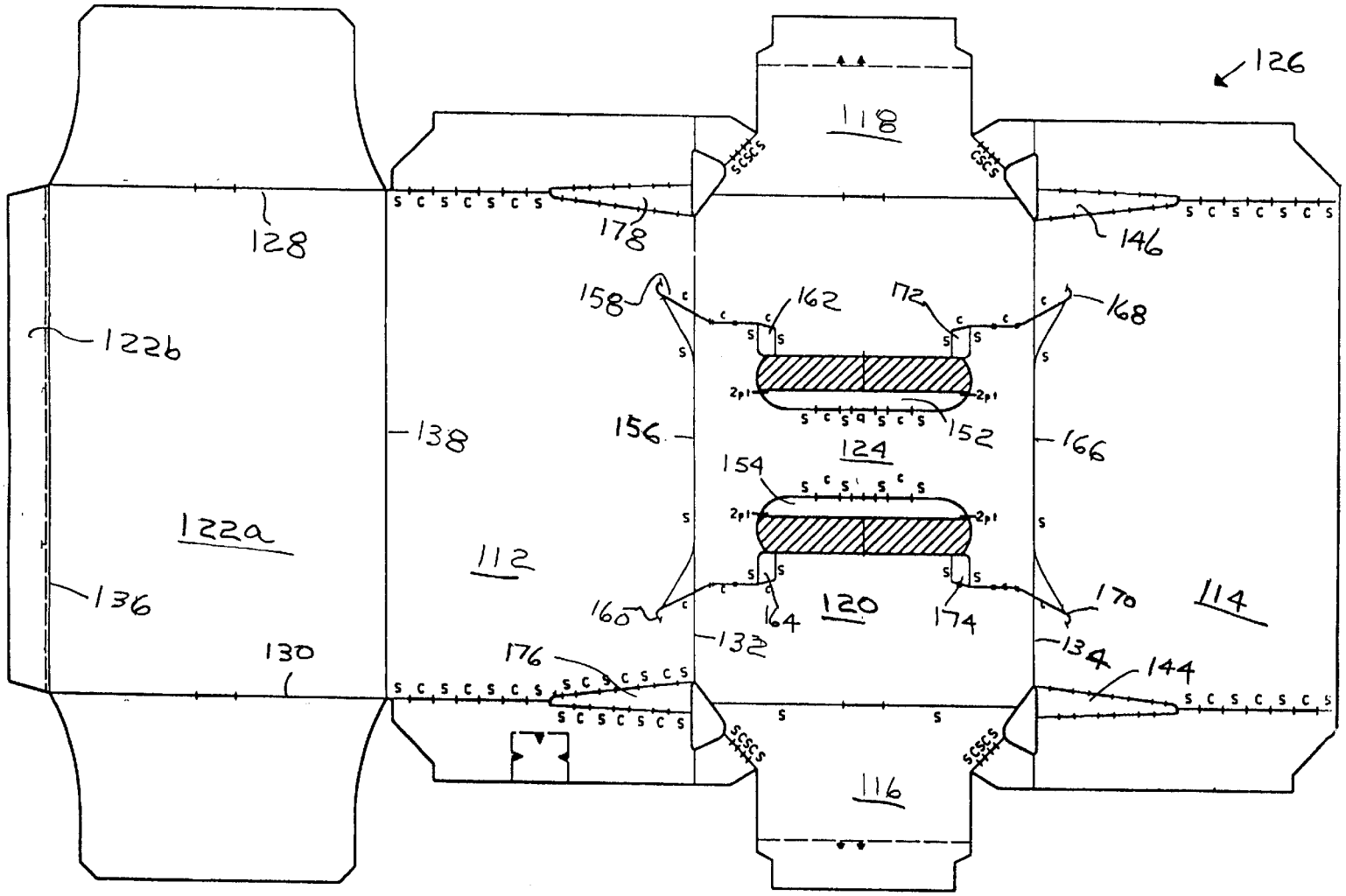
FIG. 3 illustrates a blank for a transverse strap handle carton similar to FIG. 2, but for another embodiment.

Referring to FIG. 3, another embodiment of a transverse handle strap handle is illustrated in the form of a blank for forming a carton.

Figure 4:
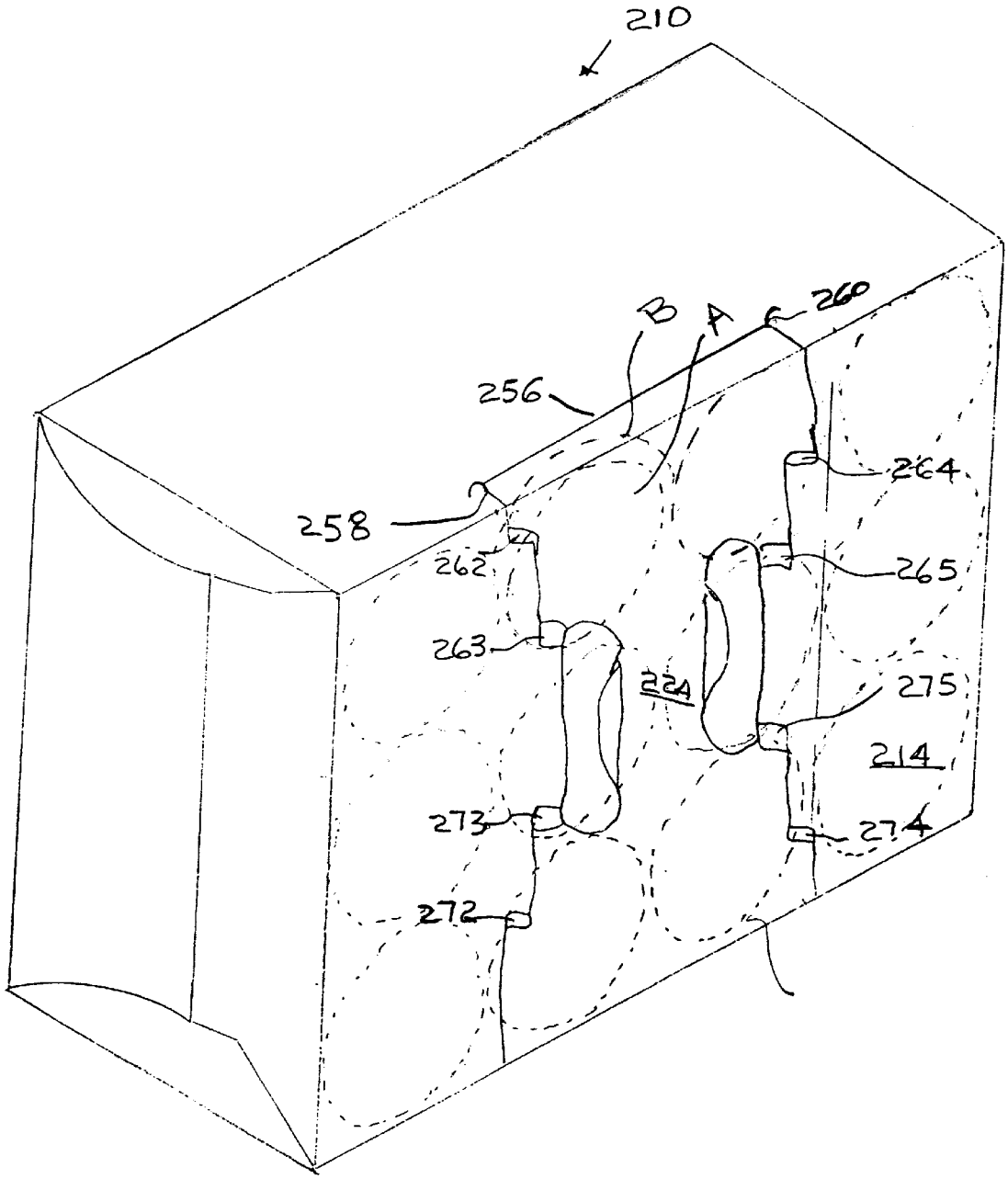
FIG. 4 is a diagrammatic perspective view of a set-up product carton with a transverse strap handle formed from a single blank similar to FIG. 1, but illustrating another preferred embodiment.

FIG. 3 illustrates a blank 126 from which a carton similar to the carton 210 shown on FIG. 4 can be formed. Blank 126 is similar to blank 26 discussed above and blank 226 described below. Blank 26 yields a 12-pack carton with articles (cans) A disposed parallel to the handle strap 24 while blank 126 yields a 6-pack style carton wherein the articles such as cans are disposed within a package formed from blank 126 with their tops or bottoms abutting the central top panel 120. Blank 126 is divided by fold lines 128 and 130 into end panels and central panels. Top panel 120 is divided by fold lines 128, 130 into the central top panel 120 and end portions 116 and 118. Side panels 112 and 114 are divided into the central panel portions and end panel portions. Top panel 120 is connected to side panel 112 along fold line 132 while it is connected along fold line 134 to side panel 114. Bottom panel **122*a* is connected along fold line 138 to side panel 112 and along fold line 136 to bottom panel flap 122*b***.

Side panel 114 contains score lines forming small triangular panels 144, 146 which flex to alter the shape of what would otherwise be perfectly square corners. Similarly, side panel 112 contains score lines forming small triangular panels 176 and 178.

Panel 120 has truncated corners giving it an octagonal configuration. A cutout exists in the blank at each corner of panel 120, but the end portions of panel 120 are connected to the adjoining end portions of panels 120 and 122 by connecting webs that are connected along fold lines to panels 112 and 114 and by score lines to the end panels 116, 118 of panel 120.

Transverse handle strap 124 has the main strap portion defined between two cutouts in top panel 120. Handle flaps 152, 154 are foldably connected along score lines to handle 124 to increase the thickness of the strap making for a more comfortable handhole in the assembled carton. The entire handle assembly stretches across top panel 120 over onto side panels 112 and 114. It thus extends across fold lines 132 and 134. The handle assembly terminates at panel 112 along a fold line 156. Fold line 156 has a vertical central portion with end portions angled toward side panel 112. This gives fold line 156 a concave or inverted "C" configuration with the ends of the "C" terminating at or near top and bottom cut lines 158 and 160. Cut line 158 extends diagonally downward toward fold line 132 then progresses horizontally onto panel 120. Similarly, cut line 160 extends diagonally upward across panel 112 to fold line 132 and then horizontally across panel 120. To prevent tearing and to further direct lifting forces into the bulk of the material of panel 112, the end portions of cut lines 158 and 160 are preferably J-shaped with the backs of the J's toward one another so that the end of the J's curve away from one another in panel 112.

A web panel 162 exists between the top handhole cutout in panel 120 and the horizontal portion of cut line 158 in panel 120. Panel 162 is defined by vertical fold lines and horizontal cut lines. When folded along the fold lines, main handle portion 124 can be lifted up out of the plane of panel 120. This makes room for a hand to be inserted to lift the carton. Similarly, along the bottom portion of handle 124 a second web panel 164 is foldably connected to operate in concert with web panel 162. Panel 164 extends along the horizontal portion of cut line 160 in panel 120.

Panels 112 and 114 work in concert about the handle to form a mirror image of the stress-directing vertical fold lines and cut lines. Vertical fold line 166 is thus the mirror image of vertical fold line 156 and serves to direct lifting forces into the bulk of the material of panel 114 to prevent tearing of the panel when the carton is lifted. Fold line 166 terminates at its top end at or near top cut line 168 and terminates its bottom end at or near bottom cut line 170. Cut line 168 is a mirror image of cut line 158, while cut line 170 is the mirror image of cut line 160. A top web panel 172 that is associated with cut line 168 is the mirror image of web panel 162, while web panel 174 that is associated with cut line 170 is the mirror image of web panel 164. When blank 126 is erected into a carton, lifting forces generated by handle 124 are spread out along panels 112 and 114 and across bottom panel 122 instead of the end panels 116, 118.

By affixing the handle in the transverse direction, the lifting forces are directed into the bulk of the material and not directly at any cut, fold, corner or weak point of the carton. The lifting forces are directed such that they are spread out to be carried by the bulk of the material rather than relying upon a special construction feature such as corners to provide the necessary strength.

Figure 5:
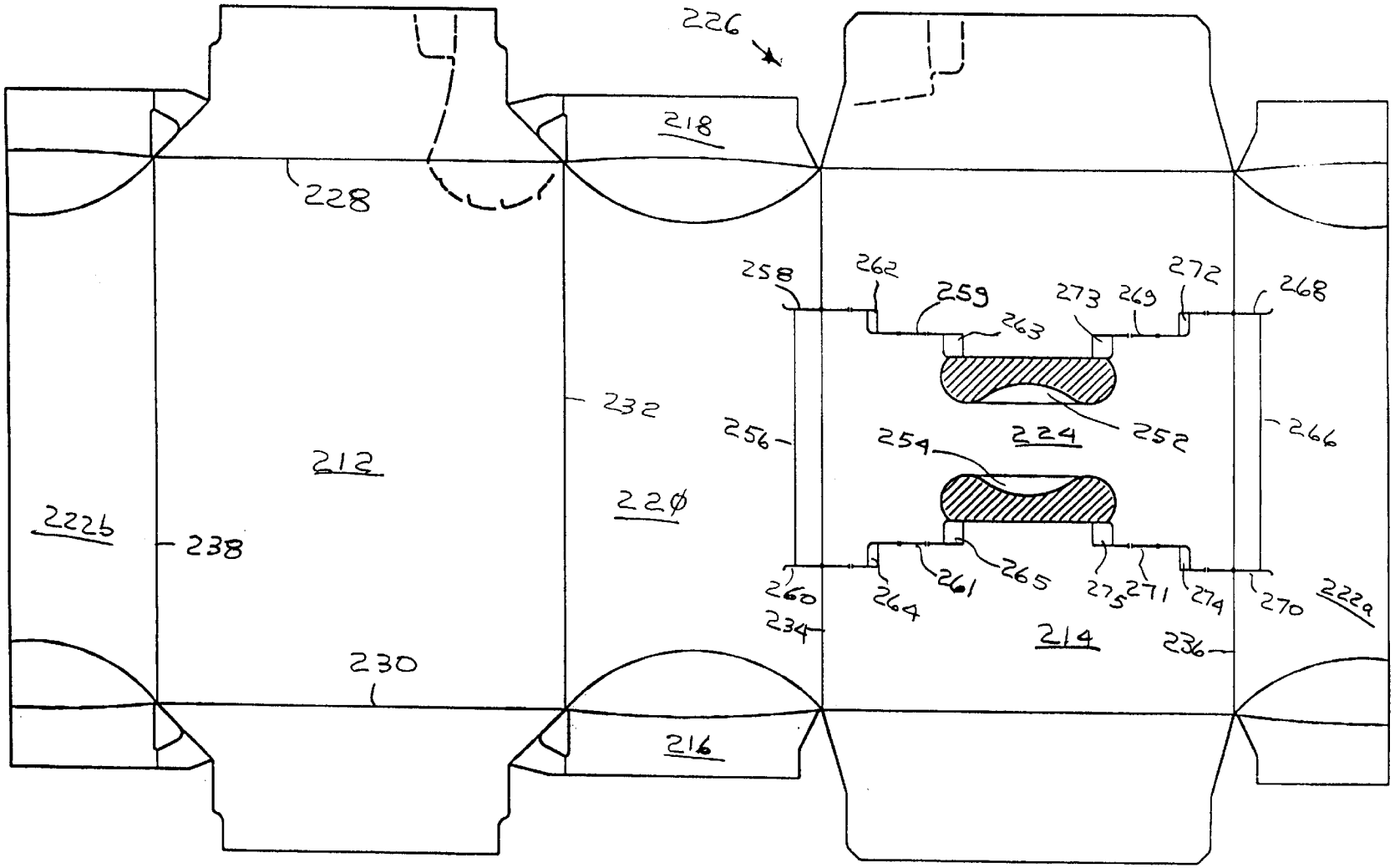
FIG. 5 illustrates the blank for the transverse strap handle of FIG. 4.

Referring to FIG. 4, a transverse handle assembly is illustrated wherein the handle strap 224 is formed in what is oriented in the erected carton as a side panel 214 of the carton 210 rather than a top panel of the carton. As stated above, the designation of a panel as "side" or "top" or otherwise is for convenience of discussion an is not intended to unduly limit the scope of the invention. The orientation of the carton 210 shown in FIG. 4 is based upon the location of the dispensing feature shown in the blank of FIG. 5. FIG. 5 illustrates a blank 226 from which carton 210 can be formed. Blank 226 is preferably formed from a single piece of material divided by fold lines 228 and 230 into end panels and central panels. Top panel 220 is divided into the central top panel 220 and end portions 216 and 218. Side panels 212 and 214 are divided into the central panel portions and end panel portions. Top panel 120 is connected to side panel 212 along fold line 232 while it is connected along fold line 234 to side panel 214. Side panel 214 is connected along fold line 236 to bottom panel 222*a*, while bottom panel 222*b* is connected along vertical fold line 238 to side panel 212.

Transverse handle strap 224 has the main strap portion defined between two cutouts in side panel 214. Handle flaps 252, 254 are connected along score lines to handle 224 to increase the thickness of the strap making for a more comfortable handhole in the assembled carton. The entire handle assembly stretches across side panel 214 over onto top panel 220 and bottom panel 222. The handle assembly thus extends across fold lines 234 and 236. The handle assembly terminates at panel 220 along a fold line 256 terminating at or near top and bottom cut lines 258 and 260. Cut line 258 extends horizontally across panel 220 toward fold line 234 then and horizontally onto panel 214. Cut line 259 begins where cut line 258 ends and continues horizontally toward the main handle portion but is positioned closer to the handle than cut line 258 producing a discontinuity between cut lines 258 and 259. Similarly, cut line 260 extends horizontally across panel 220 toward fold line 234 and horizontally onto panel 214. Cut line 261 begins where cut line 260 ends and continues horizontally toward the main handle portion but is positioned closer to the handle than cut line 260 producing a discontinuity between cut lines 260 and 261. To prevent tearing and to further direct lifting forces into the bulk of panels 220 and 222, the end portions of cut lines 258 and 260 are preferably J-shaped with the backs of the J's toward one another so that the ends of the J's curve away from one another.

A web panel 262 exists between cut lines 258 and 259 and an associated web panel 263 extends between cut line 259 and the top handhole cutout in panel 214. Panels 262 and 263 are defined by vertical fold lines and horizontal cut lines. When folded along the fold lines main handle portion 224 can be lifted up out of the plane of panel 214. This makes room for a hand to be inserted to lift the carton. Similarly, along the bottom portion of handle 224, web panels 264 and 265 are foldably connected to operate in concert with web panels 262 and 263. Web panel 264 exists between cut lines 260 and 261 and associated web panel 265 extends between cut line 261 and the bottom handhole cutout in panel 214.

Panels 214 and 220 work in concert about the handle to form a mirror image of the stress-directing vertical fold lines and cut lines. Vertical fold line 266 is thus the mirror image of vertical fold line 256 and serves to direct lifting forces into the bulk of panel 222 to prevent tearing of the panel when the carton is lifted. Vertical fold line 266 terminates at its top end at or near top cut line 268 and terminates its bottom at bottom cut line 270. As in the case of fold lines 56 and 66 in FIGS. 1 and 2 above, fold lines 256 and 266 are optimally spaced a distance from associated corner edges 234, 236 so that when the carton is loaded with articles A such as cans having a shoulder B, the portion of the carton overlying the shoulder when the carton is lifted can be encouraged to conform to the slope of the shoulder. Because of this feature, cans or other articles having shoulders do not hamper the manner in which stress is directed by fold lines 256, 266. Cut line 268 is a mirror image of cut line 258 and cut line 269 mirrors cut line 259, while cut line 270 is the mirror image of cut line 260 and cut line 271 mirrors cut line 261. Top web panel 272 associated with cut line 268 mirrors web panel 262 and web panel 273 mirrors web panel 263, while web panel 274 associated with cut line 270 mirrors web panel 264 and web panel 275 mirrors web panel 265. When blank 226 is erected into the carton, lifting forces generated by handle 224 are spread out along panels 220 and 222.

Figure 6:
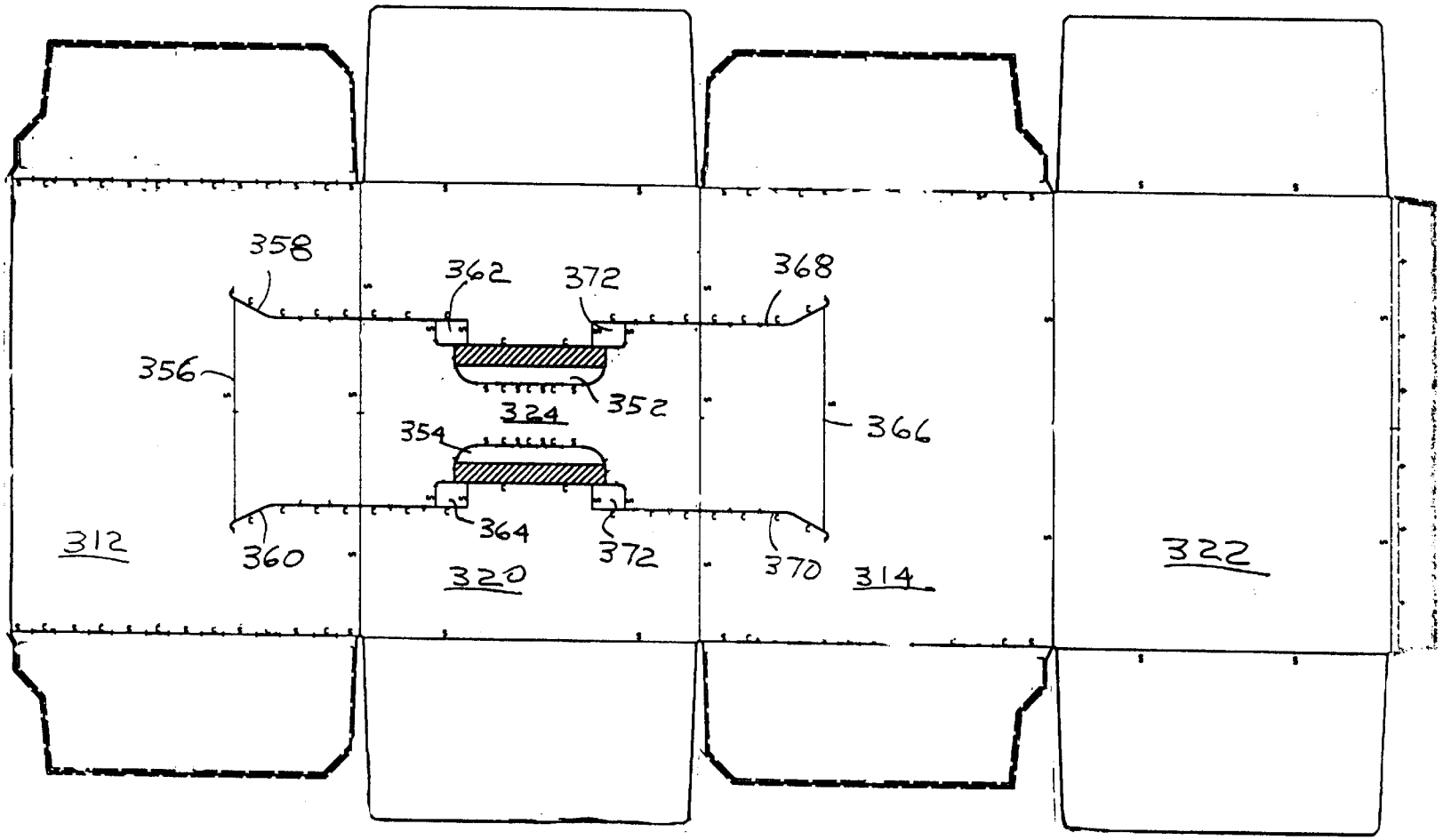
FIG. 6 illustrates a blank for a transverse strap handle carton similar to FIG. 4, but for another embodiment.

Referring to FIG. 6, another blank 326 for a transverse strap handle carton is depicted for a bottle 12-pack. The transverse strap handle is similar to the handle shown in the blanks in FIGS. 2 and 5 except that vertical fold lines are straight. Transverse handle strap 324 has the main strap portion defined between two cutouts in top panel 320. Handle flaps 352, 354 are connected along score lines to handle 324. The entire handle assembly stretches across top panel 320 over onto side panels 312 and 314 thus extending across the fold lines 332 and 334 that separate the top panel from the side panels. It terminates at side panel 312 along a fold line 356 and at side panel 314 along fold line 366. Fold line 356 terminates at or near top and bottom cut lines 358 and 360. Fold lines 356 and 366 are optimally spaced a distance from associated corner edges so that when the carton is loaded with articles such as bottles having a shoulder (in the case of bottles, lower than the shoulders of cans), the portion of the carton overlying the shoulder when the carton is lifted can be encouraged to conform to the slope of the shoulder. Because of this feature, bottles or other articles having shoulders do not hamper the manner in which stress is directed by fold lines 356, 366. Cut line 358 extends diagonally downward a short distance toward fold line 332 then progresses horizontally onto panel 320. Similarly, cut line 360 extends diagonally upward a short distance across panel 312 toward vertical fold line 332 and then horizontally across panel 320. The end portions of cut lines 358 and 360 are preferably J-shaped with the backs of the J's toward one another so that the end of the J's curve away from one another in panel 312.

A web panel 362 exists between the top handhole cutout and horizontal portion of cut line 358 in panel 320. Panel 362 is defined by vertical fold lines and horizontal cut lines. When folded along the fold lines, handle 324 can be lifted up out of the plane of top panel 320 making room for a hand to be inserted to lift the carton. Similarly, along the bottom portion of the handle, a second web panel 364 is foldably connected to operate in concert with web panel 362. Panel 364 extends along the horizontal portion of cut line 360 in panel 320.

Panels 314 and 320 work in concert about the handle to form a mirror image of the stress-directing vertical fold line and cut lines. Vertical fold line 366 is thus the mirror image of vertical fold line 356. Vertical fold line 366 terminates at its top end at or near top cut line 368 and terminates its bottom end at or near bottom cut line 370. Cut line 368 mirrors cut line 358 across the transverse axis of the handle and mirrors cut line 370 across the longitudinal axis, while cut line 370 mirrors cut line 360. A top web panel 372, associated with cut line 368, mirrors web panel 362; while web panel 374, associated with cut line 370, mirrors web panel 364. When blank 326 is erected into a carton, forces generated when lifting by the handle are spread out along panels 312 and 314 and across bottom panel 322.

Figure 7:
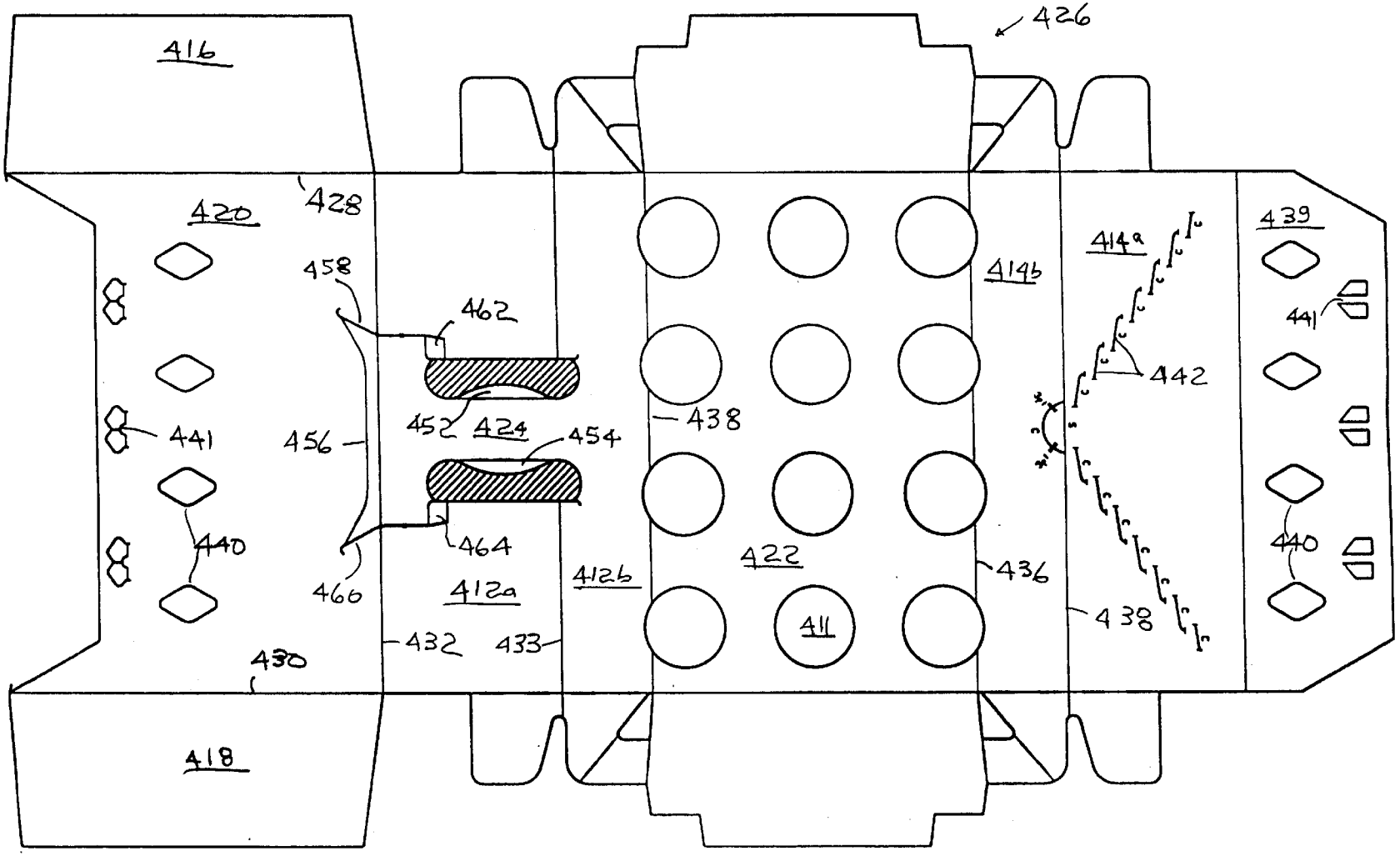
FIG. 7 illustrates another blank for a transverse strap handle carton with a frangible panel.

FIG. 7 also illustrates a transverse handle for a 12-pack bottle container with the transverse strap handle being formed in a side panel so that bottles are carried on their sides instead of upright. The handle is not symmetrical like the handle in the blank of FIG. 2 but rather has its left side similar to the left side of the handle of FIG. 2 and has its right side configured differently. The right side does not have the vertical fold line but rather has the handle strap connected directly to the panel. The side panel has a vertical fold line which bifurcates the side panel so that one portion of the side panel is perfectly vertical in the assembled carton with the other panel of the side panel assembly slanted inward to follow the contour of the bottles. The vertical fold line does not exist along the central portion of the handle so that when the blank is folded up into a carton a space is automatically created for insertion of the hand. Or, if the transverse portion of the handle follows the contour of the panels, then space is made for the insertion of the hand along the vertical fold line on the left portion of the blank.

FIG. 7 illustrates a blank 426 from which carton can be formed. Blank 426 is preferably formed from a single piece of material divided by horizontal fold lines 428 and 430 into end panels and central panels. Top panel 420 is thus divided by fold lines 428, 430 into the central top panel 420 and end portions 416 and 418. Side panels 412*a*, 412*b* and 414*a*, 414*b* are divided into the central panel portions and into end panel portions. Top panel 420 is connected to side panel 412*a* along fold line 432. Panel 412*a* is connected to panel 412*b* along fold line 433, and panel 412*b* connects to bottom panel 422 along fold line 438. Side panel 414*b* is connected along fold line 436 to bottom panel 422 and to panel 414*a*. Closure flap 439 connects to panel 414*a* along a fold line 441.

A cutout exists in the blank at each corner where the end flaps 418 of bottom panel 422 meets side panels 412*a* and 412*b*. The end portions of panel 422 are connected to the adjoining end portions of panels 412*b* and 414*b* by connecting straps that are connected along fold lines to their respective panels which allows the end panels to be neatly folded during erection of the carton.

During erection, the side panels are folded up first and the end panels last so that the connecting straps can be neatly folded between them. Side panel 414 is provided with cut lines 442 to form a tear-open access panel. The erected carton rests on bottom panel 422 with bottles standing on bottom panel 422. Side panels 412*b* and 414*b* are substantially perpendicular to the bottom panel. Side panels 412*a* and 414*a* angle inward at their tops to follow the contour of long neck bottles 411 which are narrower at the neck than the shoulder.

Transverse handle strap 424 has the main strap portion defined between two cutouts in side panels 412*a*, 412*b*. Handle flaps 452, 454 are connected along score lines to handle 424 to increase the thickness of the strap for comfort. The handle assembly stretches from panel 412*b* across top panel 412*a* over onto top panel 420. The handle assembly thus extends across fold lines 432 and 434, but fold line 433 does not intersect the handle so that the handle can fold out for gripping. The handle assembly terminates at panel 420 along a fold line 456 which has a central portion with end portions angled toward panel 420. This gives fold line 456 a concave or inverted "C" configuration with the ends of the "C" terminating at or near top and bottom cut lines 458 and 460. Fold line 456 is optimally spaced a distance from its associated corner edge 432 so that when the carton is loaded with articles such as bottles having a heel, the portion of the carton overlying the heel when the carton is lifted can be encouraged to conform to the slope of the heel. Because of this feature, cans or other articles having heels do not hamper the manner in which stress is directed by fold line 456. Cut line 458 extends diagonally downward toward fold line 432 then progresses horizontally onto panel 412*a*. Similarly, cut line 460 extends diagonally upward across panel 432 to fold line 432 and then horizontally across panel 412*a*. To prevent tearing and to further direct lifting forces into the bulk of panel 420, the end portions of cut lines 458 and 460 are preferably J-shaped with the backs of the J's toward one another so that the end of the J's curve away from one another in panel 420.

A web panel 462 exists between the top handhole cutout in panel 412 and the horizontal portion of cut line 458 in panel 412. Panel 462 is defined by vertical fold lines and horizontal cut lines. When folded along the fold lines, main handle portion 424 can be lifted up out of the plane of panel 412. This makes room for a hand to be inserted to lift the carton. Similarly, along the bottom portion of handle 424 a second web panel 464 is foldably connected to operate in concert with web panel 462. Panel 464 extends along the horizontal portion of cut line 460 in panel 412. When blank 426 is erected into a carton, lifting forces generated by handle 424 are spread out along panels 412*b* and 420. When carried, the carton can be carried on its side with the bottles oriented horizontally instead of vertically.

Figure 8:
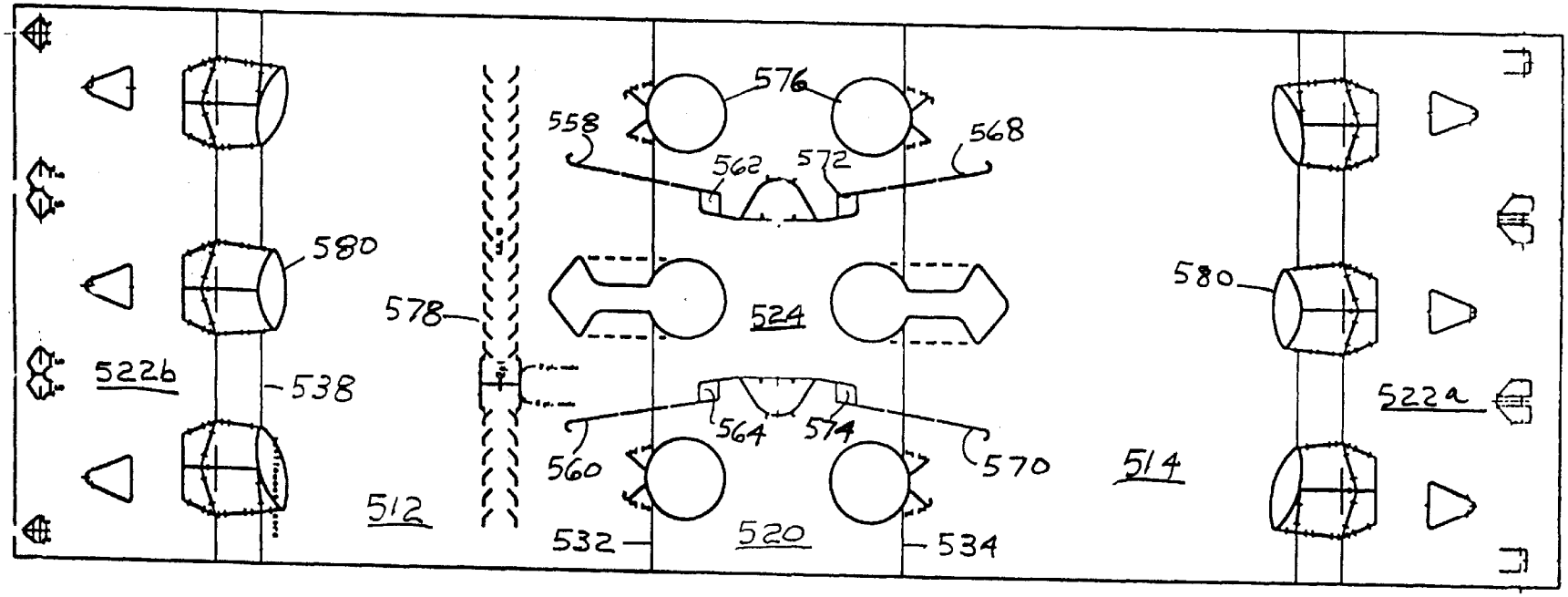
FIG. 8 illustrates a blank for a transverse strap handle carton similar to FIG. 7, but for another embodiment.

FIG. 8 illustrates a blank 526 from which a carton can be formed for a 6-pack of articles such as one-liter bottles. Top panel 520 is connected to side panel 512 along fold line 532 while it is connected along fold line 534 to side panel 514. Side panel 514 is connected along fold line 536 to bottom panel 522*a,* while bottom panel 522*b* is connected along fold line 538 to side panel 512.

Transverse handle strap 524 has the main strap portion defined between two cutouts in top panel 520. The entire handle assembly stretches across top panel 520 over onto side panels 512 and 514. The handle assembly thus extends across fold lines 532 and 534. A cut line 558 extends horizontally and slightly downward toward fold line 532 then progresses onto panel 520. Similarly, cut line 560 extends horizontally and slightly upward across panel 512 to fold line 532 and then horizontally across panel 520. To prevent tearing and to further direct lifting forces into the bulk of panel 512, the end portions of cut lines 558 and 560 are preferably J-shaped with the backs of the J's toward one another so that the end of the J's curve away from one another in panel 512.

A web panel 562 exists between the top handhole cutout in panel 520 and a portion of cut line 558 in panel 520. Panel 562 is defined by vertical fold lines and horizontal cut lines. When folded along the fold lines, main handle portion 524 can be lifted up out of the plane of panel 520. This makes room for a hand to be inserted to lift the carton. Similarly, along the bottom portion of handle 524 a second web panel 564 is foldably connected to operate in concert with web panel 562. Panel 564 extends along a portion of cut line 560 in panel 520. Cut line 568 is a mirror image of cut line 558 across the transverse axis of the handle, while cut line 570 mirrors cut line 560. A top web panel 572 associated with cut line 568 mirrors web panel 562, while web panel 574 associated with cut line 570 mirrors web panel 564. When blank 526 is erected into a carton, lifting forces generated by handle 524 are spread out along panels 512 and 514 and across bottom panels 522*a* and 522*b*.

FIG. 8 illustrates a blank for a wrap-around type carton that is void of end panels. Top panel 520 contains openings 576 for receiving the necks of the bottles. Each opening 576 is preferably circular with an adjacent frangible panel that ruptures to expand the opening for a larger bottle neck. As illustrated, there are six openings. Side panel 512 contains rows of serrations 578 forming a pull tab for accessing the contents of the carton. Bottom panels 22*a,* 522*b* contain scored panels 580 that, when erected, engage the bottoms of the bottles to prevent shifting. The bottom panels also contain locking tabs.

As is illustrated by the embodiments shown and discussed above, the strap portion of the handle 24, 124, 224, 324, 424, 524 of the carton is able to be made wider when it is transversely oriented with respect to the length and breadth of the panel which it traverses than if it was longitudinally oriented. A wider handle is stronger than one that is more narrow and thus can be made with a lesser thickness or caliper of material than a narrower handle. Similarly, the end portions of the handle that form the T-shaped connections to the carton can be made wider than if the handle was oriented longitudinally. The side panels to which stress is directed in each embodiment typically provides a maximum contiguous surface area for disbursement of stress. And, typically, the side panel does not have a joint by which it is adhered to another panel, or, if there is a joint, the side panel that receives stress is of a sufficient contiguous surface area to substantially disburse stress.

It can now be appreciated that a transverse strap handle carton and blank for forming the carton have been presented. By positioning the strap handle transversely instead of longitudinally, lifting forces and weight of the package are spread over the wider area of the side panels. The carton has a center panel, a left panel foldably connected to the center panel along a left fold line, a right panel foldably connected to the center panel along a right fold line, and a strap handle formed from the center, left and right panels. The handle extends transversely across the center panel between the left and right panels. Web panels attached to the handle and the center panel connect the handle to the center panel. The web panels, typically and even set of four or eight web panels, are used and are placed symmetrically about the longitudinal and transverse axes of the handle. They are foldably connected to the handle and center panel, and fold out away from the center panel to position the handle at a higher elevation than the center panel. The handle folds along the left and right fold lines. In one embodiment, a left end portion of the handle has a concave curvature opening toward the left panel, and a right end portion of the handle has a concave curvature opening to the right panel. In another embodiment, a left end portion of the handle has a concave curvature opening toward the left panel, and a right end portion is integral with the right panel. Each embodiment of the left and right end portions of the handle evenly distribute load to the left and right panels, respectively. The left-center-right panel combination may be a side-top-side or a top-side-bottom combination of panels.

A blank for a product carton has a center panel with a left fold line along a left edge of the panel and a right fold line along a right edge of the panel. A left panel is foldably connected to the center panel along the left fold line, and a right panel is foldably connected to the center panel along the right fold line. A strap handle is formed from the center, left and right panels, and extends transversely across the center panel between the left and right panels. In a preferred embodiment, at least four web panels are foldably connected to the handle and the center panel and connect the handle to the center panel. The web panels are symmetrically position about a longitudinal axis and a transverse axis of the handle. The handle is foldable along the left and right fold lines. In one embodiment, a left end portion of the handle has a concave curvature opening toward the left panel, and a right end portion of the handle has a concave curvature opening toward the right panel. In another embodiment, a left end portion of the handle has a concave curvature opening toward the left panel, and a right end portion of the handle is integral with the right panel.

While the invention has been described with particular reference to the preferred embodiments, it is evident that certain aspects of the invention are not limited to the particular details of the examples illustrated, and it is therefore contemplated that other modifications and applications will occur to those skilled in the art. For example, the carton can be assembled from the blank using a different sequence of steps than described, and, while a unitary blank is preferred, a multi-piece blank can be used. It is accordingly intended that the claims shall cover all such modifications and applications as do not depart from the true spirit and scope of the invention.

What is claimed is:

1. A carton, comprising:

a plurality of panels including a top panel and first and second opposed side panels foldably adjoining said top panel;

a strap handle integrally formed with and extending transversely across said top panel having at least one distal end region terminating either at respective lines of joinder between said top panel and said opposed side panels or within said side panels, and having a grasping region defined between said end regions; and at least one web interconnecting said strap handle and said top panel proximate said grasping region.

2. A carton, as set forth in claim 1, wherein said web panels are fold outwardly of said top panel positioning said handle at a higher elevation than said top panel.

3. A carton, as set forth in claim 1, wherein said web panels fold outwardly of said top panel positioning said handle at a higher elevation than said top panel.

4. A carton, as set forth in claim 1, wherein said grasping region is defined at least in part by an aperture on at least one side of said handle.

5. A carton, as set forth in claim 1, wherein said distal end region is defined by spaced apart severance lines and includes a fold line extending between said severance lines.

6. A carton, as set forth in claim 5, wherein at least a portion of said fold line is substantially coincident with a respective said line of joinder between said top panel and said opposed side panels.

7. A carton, as set forth in claim 5, wherein said fold line has an arcuate configuration defining a concavity opening toward a proximate terminal end of said handle.

8. A carton, as set forth in claim 5, wherein said fold line is proximate terminal regions of said severance lines.

9. A carton, as set forth in claim 5, wherein said fold line intersects said severance lines.

10. A carton, as set forth in claim 1, wherein said web is defined at least in part by spaced apart substantially parallel web fold lines.

11. A carton, as set forth in claim 1, wherein said grasping region is defined at least in part by an elongated aperture on at least one side of said handle and each said web interconnects said strap handle and said top panel proximate an end region of said elongated aperture.

12. A carton, comprising:

a first panel;

a second panel foldably connected to said first panel along a first fold line;

a third panel foldably connected to said first panel along a second fold line; and a strap handle integrally formed with and extending transversely across said first panel between said second and third panels having at least one distal end region terminating either at respective said first and second fold lines or within said second and third panels, and having a grasping region defined between said end regions; and at least one web interconnecting said strap handle and said first panel proximate said grasping region.

13. A carton, as set forth in claim 12, wherein said webs fold outwardly of said first panel to position said handle at a higher elevation than said first panel when the carton is lifted by said handle.

14. Carton, as set forth in claim 12, wherein said grasping region is defined at least in part by an aperture on at least one side of said handle.

15. A carton, as set forth in claim 12, wherein said distal end region is defined by spaced apart severance lines and includes a fold line extending between said severance lines.

16. A carton, as set forth in claim 15, wherein at least a portion of said fold line is substantially coincident with a respective said first and second fold line.

17. Carton, as set forth in claim 15, wherein said fold line has an arcuate configuration defining a concavity opening toward a proximate terminal end of said handle.

18. Carton, as set forth in claim 15, wherein said fold line is proximate terminal regions of said severance lines.

19. A carton, as set forth in claim 15, wherein said fold line intersects said severance lines.

20. A carton, as set forth in claim 12, wherein said web is defined at least in part by spaced apart substantially parallel web fold lines.

21. A carton, as set forth in claim 12, wherein said grasping region is defined at least in part by an elongated aperture on at least one side of said handle and each said web interconnects said strap handle and said top panel proximate an end region of said elongated aperture.

22. A blank for a carton, comprising:

a center panel having a left fold line along a left edge and a right fold line along a right edge;

a left panel foldably connected to said center panel along said left fold line;

a right panel foldably connected to said center panel along said right fold line; and a strap handle integrally formed with and extending transversely across said center panel between said left and right panels, having at least one distal end region terminating either at respective said left and right fold lines or within respective proximate said left and right panels, and having a grasping region defined between said end regions; and at least one web interconnecting said strap handle and said center panel proximate said grasping region.

23. A blank, as set forth in claim 22, wherein said grasping region is defined at least in part by an aperture on at least one side of said handle.

24. A blank, as set forth in claim 22, wherein said distal end region is defined by spaced apart severance lines and includes a fold line extending between said severance lines.

25. A blank, as set forth in claim 24, wherein at least a portion of said fold line is substantially coincident with a respective said right and left fold line.

26. A carton, as set forth in claim 24, wherein said fold line has an arcuate configuration defining a concavity opening toward a proximate distal end of said handle.

27. A carton, as set forth in claim 24, wherein said fold line is proximate terminal regions of said severance lines.

28. A carton, as set forth in claim 24, wherein said fold line intersects said severance lines.

29. A carton, as set forth in claim 22, wherein said web is defined at least in part by spaced apart substantially parallel web fold lines.

30. A carton, as set forth in claims 22, wherein said grasping region is defined at least in part by an elongated aperture on at least one side of said handle and each said web interconnects said strap handle and said top panel proximate an end region of said elongated aperture.

* * * * *